US007103538B1

(12) United States Patent
Gao

(10) Patent No.: US 7,103,538 B1
(45) Date of Patent: Sep. 5, 2006

(54) FIXED CODE BOOK WITH EMBEDDED ADAPTIVE CODE BOOK

(75) Inventor: Yang Gao, Mission Viejo, CA (US)

(73) Assignee: Mindspeed Technologies, Inc., Newport Beach, CA (US)

( * ) Notice: Subject to any disclaimer, the term of this patent is extended or adjusted under 35 U.S.C. 154(b) by 772 days.

(21) Appl. No.: 10/166,315

(22) Filed: Jun. 10, 2002

(51) Int. Cl.
*G10L 19/14* (2006.01)

(52) U.S. Cl. ..... 704/223; 704/219

(58) Field of Classification Search ..... 704/219, 704/223
See application file for complete search history.

(56) References Cited

U.S. PATENT DOCUMENTS 5,007,092 A * 4/1991 Galand et al. ..... 704/222
5,553,191 A * 9/1996 Minde ..... 704/219
5,719,993 A * 2/1998 Kleijn ..... 704/220
6,014,618 A * 1/2000 Patel et al. ..... 704/219
6,345,247 B1 * 2/2002 Yasunaga et al. ..... 704/219
6,470,312 B1 * 10/2002 Suzuki et al. ..... 704/219
6,691,082 B1 * 2/2004 Aguilar et al. ..... 704/219
6,757,654 B1 * 6/2004 Westerlund et al. ..... 704/219

OTHER PUBLICATIONS

"The SMV Algorithm Selected by TIA and 3GPP2 for CDMA Applications," Yang Gao, et al., Conexant Systems, Inc., 2001.
*Selectable Mode Vocoder Service Otion for Wideband Spread Spectrum Communication Systems*, 3GPP2 C.S0030-0, ver. 4.0, Jun. 15, 2001.
"Approved Summary of 3GPP2 TGS-C Meetings for Mar. 26-30, 2001 in Seattle, WA," Clifton J. Barber, Tantiviy Communications, Melbourne, FL 30291, 2001.
"Analysis-by-Synthesis Linear Predictive Coders", Various Charts numbered VI-I, Andreas Spanias, Mar. 2000.
"A 4 KBPS Adaptive Fixed Code-Excited Linear Prediction Speech Coder," Hong Kook Kim, et al., 1997.
"Linear Predictive Coding (LPC)", Otolith, Oct. 17, 1995.
"Waveform Coding and Vocoders," Sections 3.14 and 5.7, Undated.

* cited by examiner

*Primary Examiner*—Michael N. Opsasnick
(74) *Attorney, Agent, or Firm*—Farjami & Farjami LLP

(57) ABSTRACT

A system including an adaptive code book and a fixed code book for code excited linear prediction coding of speech signals is provided. The invention includes an embedded adaptive code book in the fixed code book and the selection procedure for selecting excitation vector parameters. A code book update system updates the fixed code book with embedded adaptive code book based on the long term processing excitation vector parameters with previous synthesized excitation.

21 Claims, 4 Drawing Sheets

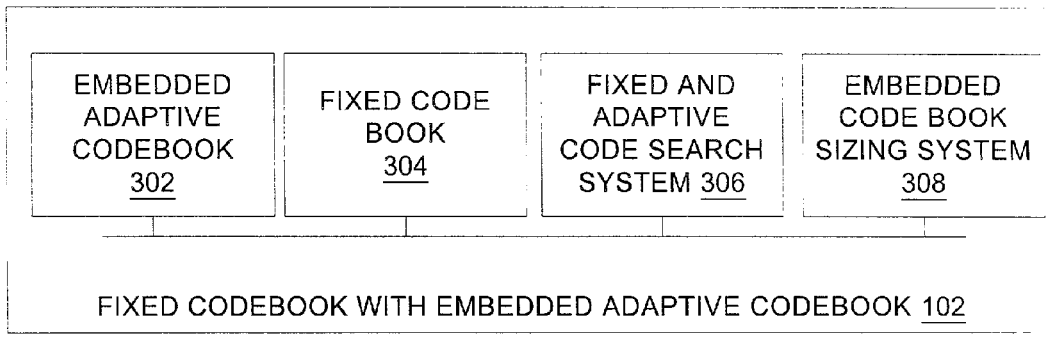
300 FIGURE 3
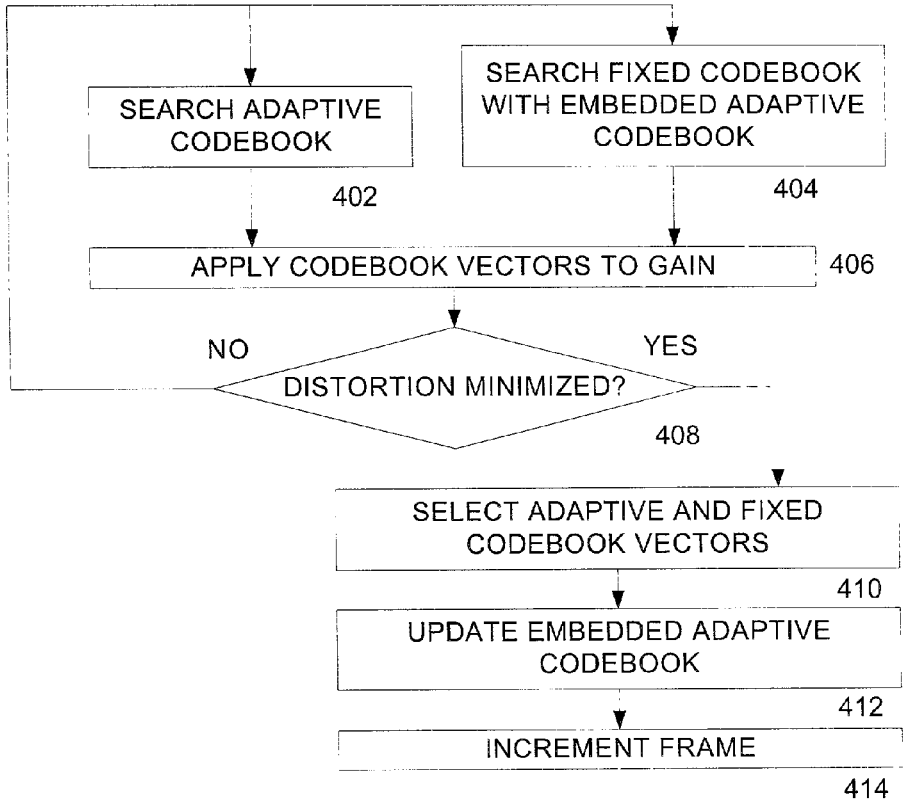
400 FIGURE 4

FIXED CODE BOOK WITH EMBEDDED ADAPTIVE CODE BOOK

BACKGROUND OF THE INVENTION

1. Field of the Invention

The present invention relates to code excited linear prediction of speech signals and more particularly to a fixed code book with an embedded adaptive code book.

2. Background of the Invention

Code excited linear prediction coders are used to generate human speech signals in bandwidth limited environments, using what is sometimes referred to as "analysis by synthesis." In particular, a code excited linear prediction coder uses a fixed code book excitation signal that relies on stored excitation vector parameter codes that are selected from a code book, and adaptive code book excitation vectors parameters that are representative of long-term processing. The adaptive code book typically contains candidate vectors constructed from past synthesized excitation which are available in the decoder. The number of the candidates in the adaptive code book is usually much smaller than the number in the fixed code book, and the adaptive code book is continually updated based on past excitation vector parameters.

Although such fixed and adaptive excitation code books provide acceptable speech encoding in most cases, when a significant difference in the spectrum or pitch lag of the voice signal occurs, long term processing through the use of adaptive code book entries can occasionally fail. Although a switch to traditional long term processing can be made when long term processing in a CELP coder fails, the switching can cause the algorithm to be less robust to bit errors, such that noticeable speech errors are generated. When the pitch lag is coded in a differential way to save the bit rate, even the traditional long term prediction could fail.

SUMMARY OF THE INVENTION

In accordance with the present invention, a system and method for code excited linear prediction coding of speech signals are provided that overcome known problems with systems and methods for code excited linear prediction of speech signals.

In one embodiment, a system and method for code excited linear prediction of speech signals are provided that use a fixed code book with an embedded adaptive code book to prevent long term processing failure due to a dramatic change in the spectrum or pitch lag of a sampled voice signal.

In accordance with an exemplary embodiment of the present invention, a system for code excited linear prediction coding of speech signals is provided. The system includes a fixed code book with embedded adaptive code book for selecting excitation vector parameters. The system also includes an adaptive code book for selecting long term excitation vector parameters. A code book update system updates the fixed code book with embedded adaptive code book based on the long term excitation vector parameters.

The present invention provides many important technical advantages. One important technical advantage of the present invention is a fixed code book with embedded adaptive code book that compensates for the quality loss due to dramatic changes in the spectrum or pitch lag of a sampled voice signal to be processed. Because the adaptive codes with full search range require significantly less space as compared to the fixed codes, including the adaptive codes in the fixed code book does not significantly increase the fixed code book size, and further allows avoiding a switch to traditional long term processing, thus reducing sensitivity to bit error.

Other features of the invention will be apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE SEVERAL VIEWS OF THE DRAWINGS

The components in the figures are not necessarily to scale, emphasis instead being placed upon illustrating the principles of the invention. In the figures, like reference numerals designate corresponding parts throughout the different views.

FIG. 3 is a diagram of a system for providing a fixed code book with embedded adaptive code book in accordance with an exemplary embodiment of the present invention.

FIG. 4 is a flowchart of a method for processing speech signals using a fixed code book with an embedded adaptive code book in accordance with an exemplary embodiment of the present invention.

DETAILED DESCRIPTION OF THE INVENTION

Figure 1:
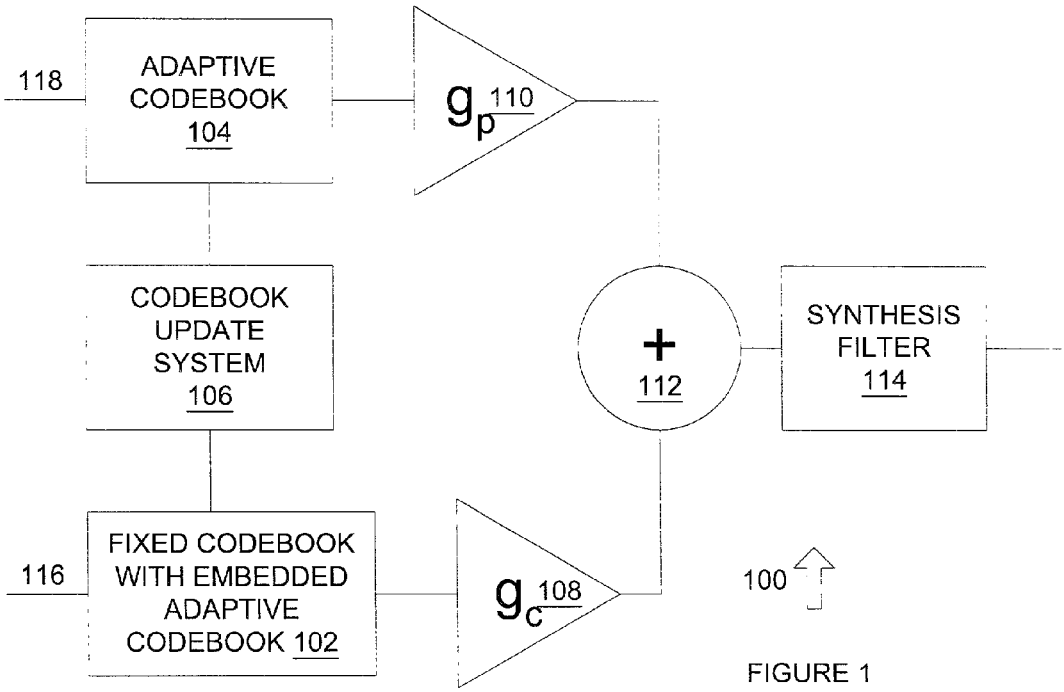
FIG. 1 is a diagram of a system for providing a fixed code book with an embedded adapted code book in accordance with an exemplary embodiment of the present invention.

FIG. 1 is a diagram of a system 100 for providing a fixed code book with an embedded adapted code book in accordance with an exemplary embodiment of the present invention. System 100 facilitates the processing of speech for encoding and transmission by providing adaptive code book entries in a fixed code book so as to prevent long term processing failure due to dramatic changes in the spectrum or pitch lag of the speech signal being processed.

System 100 includes fixed code book with embedded adaptive code book 102, adaptive code book 104, code book update system 106, fixed code book gain amplifier 108, adaptive code book gain amplifier 110, adder 112 and synthesis filter 114, coupled as shown. Although the embedded adaptive code book inside fixed code book with embedded adaptive code book 102 can contain all suitable adaptive code vectors constructed with all suitable pitch lags, the embedded adaptive code book section is usually much smaller than the fixed code book section, but generally larger than adaptive code book 104 which includes limited candidates due to the reduction of the bit rate. The contribution from adaptive code book 104 could occasionally fail because it is generated with limited possible pitch lags or one pitch lag track when the long-term pitch processing is applied. This failure can be compensated for by including the embedded adaptive code book with a full pitch lag search range in the fixed code book. Each of the above units can be implemented in hardware, software, or a suitable combination of hardware and software, and which can be one or more hardware systems, or one or more software systems operating on a digital signal processor or other suitable processing platforms. As used herein, a hardware system can include discrete or integrated semiconductor devices implemented in silicon, germanium, or other suitable materials; an application-specific integrated circuit; a field programmable gate array; or other suitable devices. A software system can include one or more objects, agents, threads, lines of code, subroutines, separate software applications, user-readable (source) code, machine-readable (object) code, two or more lines of code in two or more corresponding software applications, databases, or other suitable software architectures. In one exemplary embodiment, a software system can include one or more lines of code in a general purpose software application, such as an operating system of a digital signal processor, and one or more lines of software in a specific purpose software application. The term "couple" and its cognate terms, such as "coupled" and couples," can include a physical connection (such as through a conducting material in a semiconductor circuit), a logical connection (such as through one or more logical devices of a semiconducting circuit), a virtual connection (such as through one or more randomly assigned memory locations of a data memory device), other suitable connections, or a suitable combination of such connections. In one exemplary embodiment, systems or components can be coupled to other systems and components through intervening systems and components, such as through an operating system of a memory controller.

Fixed code book with embedded adaptive code book 102 receives pitch lag candidates and past synthesized excitation 116 to generate the embedded adaptive code vector candidates, and selects a code book entry from the embedded adaptive code book or the fixed code book to generate an excitation signal through fixed code book gain amplifier 108. Likewise, adaptive code book 104 receives pitch lag candidates 118 and generates adaptive excitation vector parameters for generation of an excitation signal through adaptive code book gain amplifier 110. These excitation signals are then added through adder 112 and processed by synthesis filter 114 to generate an excitation signal. The excitation signal is then compared with a speech signal, and a weighted error generation process or other suitable processes are performed to determine whether the speech signal generated using the codes selected from adaptive code book 104 and fixed code book with embedded adaptive code book 102 is suitably close enough to the original speech signal. If it is determined that the difference between the synthesized signal and the speech signal is not sufficiently small, then a new set of codes is selected from adaptive code book 104 and fixed code book with embedded adaptive code book 102. This process is repeated until suitable codes are selected for transmission to a receiver. The receiver then regenerates the speech signal by using the codes, thus eliminating the need to transmit speech signal data that specifically identifies the speech signal.

Fixed code book with embedded adaptive code book 102 receives adaptive code book excitation vector parameters from code book update system 106, which receives them in turn from adaptive code book 104. Adaptive code book 104 provides long term processing excitation vector parameters, whereas fixed code book with embedded adaptive code book 102 provides fixed excitation vector parameters or long term processing excitation vector parameters. Code book update system 106 is used to store long term processing excitation vector parameters generated from adaptive code book 104 in fixed code book with embedded adaptive code book 102. In this manner, if a dramatic change in the spectrum of the voice signal or pitch lag occurs and adaptive code book 104 fails, the significant long term pitch contribution could be still obtained because the long term excitation vector parameters are available in fixed code book with embedded adaptive code book 102.

Code book update system 106 updates adaptive code book long term processing excitation vector parameters in fixed code book with embedded adaptive code book 102 in a suitable manner. In one exemplary embodiment, code book update system 106 can monitor the long term processing excitation vector parameters in fixed code book with embedded adaptive code book 102, and can update the old entry with the most recent long term processing excitation vector parameters from adaptive code book 104. In another exemplary embodiment, code book update system 106 can periodically update fixed code book with long term processing excitation vector parameters from fixed code book with embedded adaptive code book 102 every time a new excitation vector parameter is generated by adaptive code book 104. Other suitable processes can likewise be used. Code book update system 106 can interface with adaptive code book 104 and fixed code book with embedded adaptive code book 102.

In operation, system 100 prevents long term processing failure by storing long term processing excitation vector parameters in fixed code book with embedded adaptive code book 102. In this manner, if a dramatic change in the spectrum or pitch lag occurs that would otherwise cause the adaptive codes stored in adaptive code book 104 to be inapplicable, such codes are present in fixed code book with embedded adaptive code book 102 without switching between different bit allocations which can cause the system to be more sensitive to bit error.

Figure 2:
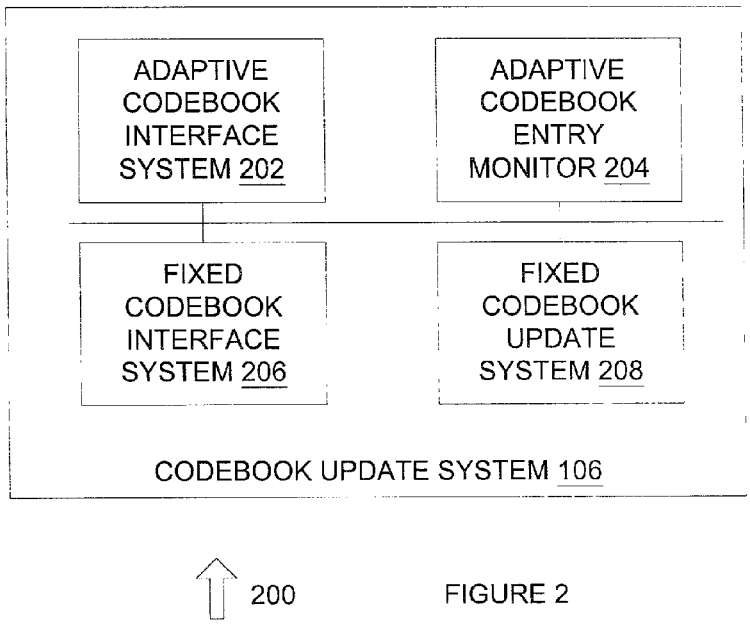
FIG. 2 is a diagram of a system for providing long term processing excitation vector parameters from an adaptive code book to a fixed code book with an embedded adaptive code book in accordance with an exemplary embodiment of the present invention.

FIG. 2 is a diagram of a system 200 for providing long term processing excitation vector parameters from an adaptive code book to a fixed code book with an embedded adaptive code book in accordance with an exemplary embodiment of the present invention. System 200 includes code book update system 106 and adaptive code book interface system 202, adaptive code book entry monitor 204, fixed code book interface system 206, and fixed code book update system 208, each of which can be implemented in hardware or software, and which can be one or more hardware systems, or one or more software systems operating on a suitable processing platform.

Adaptive code book interface system 202 interfaces with an adaptive code book to receive excitation vector parameters from long term processing. In one exemplary embodiment, adaptive code book interface system 202 can be a data register that receives each new excitation vector parameter set generated by an adaptive code book, can query the adaptive code book to determine whether a new excitation vector parameter set has been generated, or can otherwise interface with an adaptive code book.

Adaptive code book entry monitor 204 monitors entries in an adaptive code book, such as by determining whether the excitation vector parameters have changed, whether the current excitation vector parameters are different from the previous excitation vector parameters, or whether other suitable changes have occurred. In one exemplary embodiment, adaptive code book entry monitor 204 can compare a first register with a second register to determine whether the register entries are identical. In another exemplary embodiment, adaptive code book entry monitor can include one or more timing circuits that periodically generate control data to cause excitation vector parameters from an adaptive code book to be retrieved or read. Other suitable processes can also or alternatively be performed.

Fixed code book interface system 206 interfaces with a fixed code book with embedded adaptive code book 102 to update the fixed code book with embedded adaptive code book with long term processing excitation vector parameters received from an adaptive code book 104. In one exemplary embodiment, fixed code book interface system 206 can query individual embedded adaptive code book entries so as to allow them to be compared to a most recent adaptive code book excitation vector parameter set. Likewise, fixed code book interface system 206 can store an excitation parameter set from an adaptive code book 104 in the next storage location, such as one that corresponds with the past excitation vector parameter location, one that is randomly selected, or other suitable storage locations. Likewise, the long term processing excitation vector parameter sets can be determined such that fixed code book interface system can increase or decrease the size of the embedded adaptive code book. Other suitable or alternative processes can be used.

Fixed code book update system 208 provides processing functionality for updating long term processing excitation vector parameters in a fixed code book with embedded adaptive code book 102. In one exemplary embodiment, fixed code book update system 208 can compare one or more excitation vector parameters from a fixed code book with embedded adaptive code book 102 with excitation vector parameters from an adaptive code book or the past synthesized excitation, or can determine the best entry in an embedded adaptive code book of a fixed code book 102 by comparing candidate code vectors from the fixed code book, or can perform other suitable functions to allow updating of a fixed code book with an embedded adaptive code book 102.

In operation, system 200 provides code book update functionality for a fixed code book with an embedded adaptive code book 102, so as to allow long term processing excitation vector parameters to be updated based on updates received from an adaptive code book 104 or other suitable sources.

FIG. 3 is a diagram of a system 300 for providing a fixed code book with embedded adaptive code book in accordance with an exemplary embodiment of the present invention. System 300 includes fixed code book with embedded adaptive code book 102, which further includes embedded adaptive code book 302, fixed code book 304, fixed and adaptive code search system 306, and embedded code book sizing system 308, each of which can be implemented in hardware, software or a suitable combination of hardware and software which can be one or more hardware systems or one or more software systems operating on a suitable processing platform.

Embedded adaptive code book 302 includes a plurality of candidate excitation code vectors constructed from the past synthesized excitation with possible pitch lags. Embedded adaptive code book 302 is integrated with fixed code book 304, which stores a plurality of fixed codes that are not changed. In this manner, embedded adaptive code book 302 and fixed code book 304 can be searched by a suitable search algorithm, search system, or other suitable processes.

Fixed and adaptive code search system 306 can search embedded adaptive code book 302 and fixed code book 304 based on minimizing a weighted error between the original speech and the synthesized speech signal or other suitable differential technique. In one exemplary embodiment, fixed and adaptive code search system 306 can select one of embedded adaptive code book 302 and fixed code book 304 for searching based on an error signal or other suitable control data. In this exemplary embodiment, embedded adaptive code book 302 can be interfaced with fixed code book 304 such that Gaussian searching, Boolean searching, linear searching, or other suitable search processes can be used. Thus, if an embedded adaptive code book 302 entry is used and generates an error signal of a certain magnitude, fixed and adaptive code search system 306 can determine whether to use fixed code book 304 for the excitation vector parameter set or embedded adaptive code book 302 for the excitation vector parameter set. Other suitable processes can likewise be performed.

Embedded code book sizing system 308 adjusts the size of the embedded adaptive code book based on the pitch lag or other suitable factors. Embedded code book sizing system 308 increases or decreases the number of code book entries, interfaces with fixed and adaptive code search system 306 to allow the new entries to be searched or to prevent searching of entries that are no longer present or active, or performs other suitable processes.

In operation, system 300 allows a fixed code book with embedded adaptive code book to be used to code speech in a code excited linear prediction speech coding system. System 300 provides search functionality for a fixed code book with an embedded adaptive code book so that a suitable code can be selected for encoding voice signals.

FIG. 4 is a flowchart for a method 400 for processing speech signals using a fixed code book with an embedded adaptive code book in accordance with an exemplary embodiment of the present invention.

Method 400 begins at 402 where an adaptive code book is searched for a long term processing excitation code vector, and a suitable excitation code vector is selected. The searching can use historical search data reflecting prior search results, error signal data, or other suitable data. The method also begins at 404 where a fixed code book with an embedded adaptive code book is also searched, in the same manner as the search of the adaptive code book, or in other suitable manners. If a dramatic change in the spectrum or pitch lag of the voice sample has occurred such that the long term processing excitation vector codes in the adaptive code book are not suitable, then other suitable excitation vector codes are available in the fixed code book with embedded adaptive code book, as a suitable lag for the embedded adaptive code book can be used. The method then proceeds to 406.

At 406, the adaptive code book long term processing excitation code vector and the excitation code vector from the fixed code book with embedded adaptive code book are applied to the fixed code book gain and predictive code book gain, respectively. In one exemplary embodiment, the process signals are then combined and matched with a voice sample to determine whether the energy in the error signal is minimized. Likewise, other suitable processing can be performed to determine whether the synthesized speech signal is sufficiently close to the sampled speech signal. The method then proceeds to 408.

At 408, it is determined whether distortion has been minimized. For example, distortion can be minimized when the energy of an error signal is sufficiently low, based on frequency content, or based on other suitable factors. If it is determined that distortion has not been suitably minimized, the method returns to 402. Otherwise, the method proceeds to 410.

At 410, the adaptive code book and fixed code book with embedded adaptive code book excitation vector codes are selected for transmission to the receiving end, where they are used to generate a speech signal. The method then proceeds to 412.

At 412, the embedded adaptive code book is updated, such as by retrieving an excitation signal vector from an adaptive code book and storing it in the embedded adaptive code book, or by other suitable processes. The method then proceeds to 414 where the next frame is incremented for processing.

In operation, method 400 allows speech signals to be processed and encoded for transmission, such as in a code excited linear prediction speech encoding system. Method 400 prevents long term processing failure when dramatic changes in spectrum or pitch lag of the voice signal occur, by storing long term processing excitation vector parameters in an embedded adaptive code book of a fixed code book, where a suitable pitch lag for the embedded adaptive code book can be used.

Figure 5:
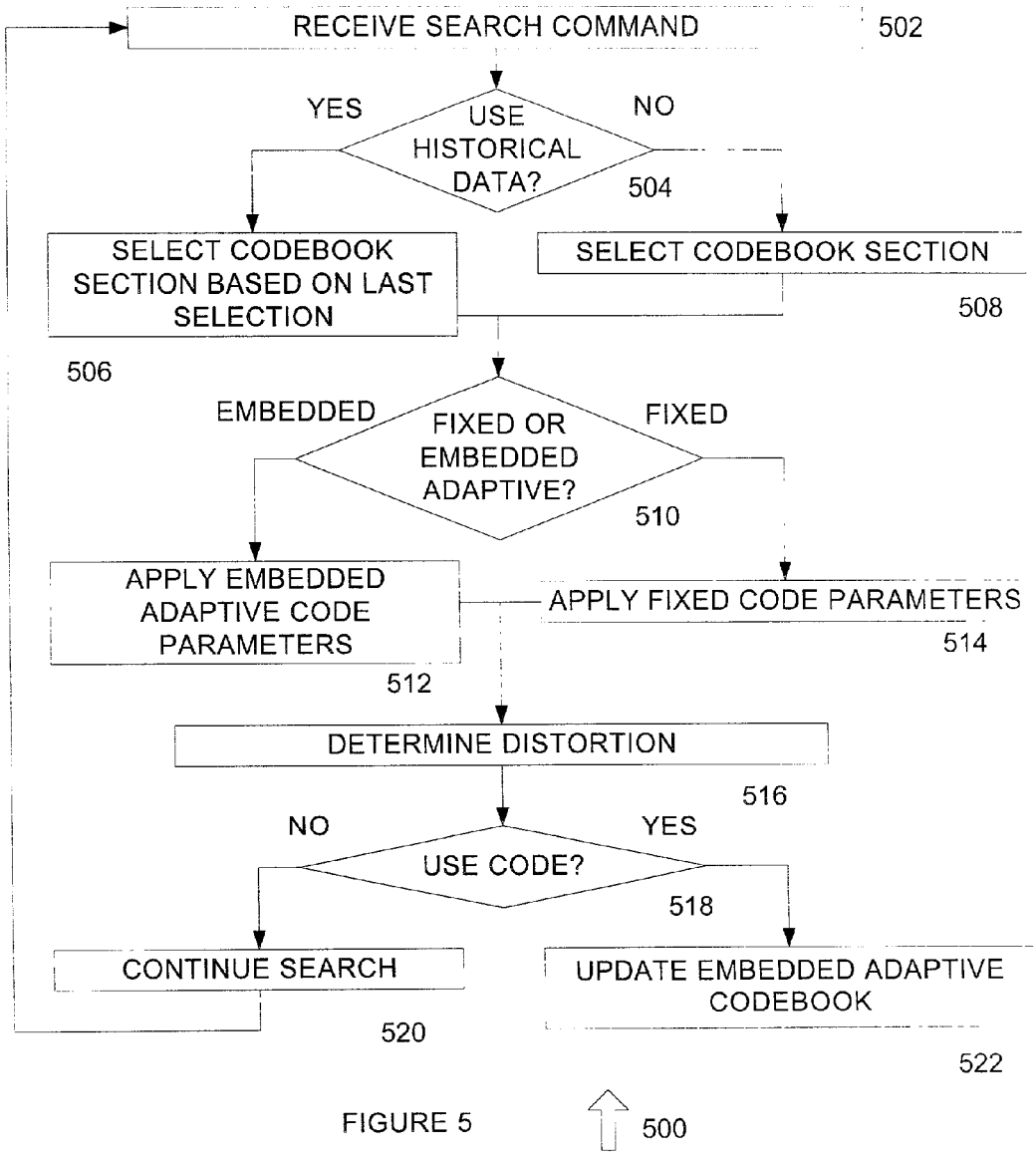
FIG. 5 is a flowchart of a method for searching a fixed code book with an embedded adaptive code book in accordance with an exemplary embodiment of the present invention.

FIG. 5 is a flowchart of a method 500 for searching a fixed code book with an embedded adaptive code book in accordance with an exemplary embodiment of the present invention. Method 500 begins at 502 where a search command is received. The method then proceeds to 504 where it is determined whether historical data should be used to search. In one exemplary embodiment, the search can be performed in a section of the fixed code book with embedded adaptive code book based on the section of the fixed code book with embedded adaptive code book from which the previous excitation segment vector was extracted. If it is determined at 504 that historical data will be used, the method proceeds to 506, where the excitation vector parameters are selected from the code book based on the area from the code book in which the last selection was made. Otherwise, the method proceeds to 508 where a code book section is selected based on a suitable search algorithm or process, such as a Gaussian search, Boolean search, linear search or other suitable searches. The method then proceeds to 510.

At 510, it is determined whether a fixed or embedded adaptive segment of the code book has been selected. If it is determined that an embedded adaptive segment of the code book has been selected, the method proceeds to 512 where embedded adaptive code parameters are applied to an excitation signal. Otherwise, the method proceeds to 514, where fixed code parameters are applied to the excitation signal. The method then proceeds to 516.

At 516, the distortion of the speech signal generated using the adaptive code book and fixed code book with embedded adaptive code book entries is determined. The method then proceeds to 518. If it is determined that the distortion generated is minimized or if other suitable processes are performed that indicate that the codes can be used, the method proceeds to 522, where the code is used and the embedded adaptive code book is updated. Otherwise, the method proceeds to 520, where the search through the adaptive code book and the embedded adaptive code book is continued, such as by generation of a search command.

In operation, method 500 allows a fixed code book with embedded adaptive code book to be used in conjunction with an adaptive code book to select excitation vector parameters for use in a code excited linear predictive voice coding system. Method 500 prevents long term processing failure due to dramatic changes in spectrum or pitch lag which can influence the quality of the voice signal when the excitation is not rich enough. Method 500 prevents switching between different bit allocations which can cause the system to be more sensitive to bit error.

Figure 6:
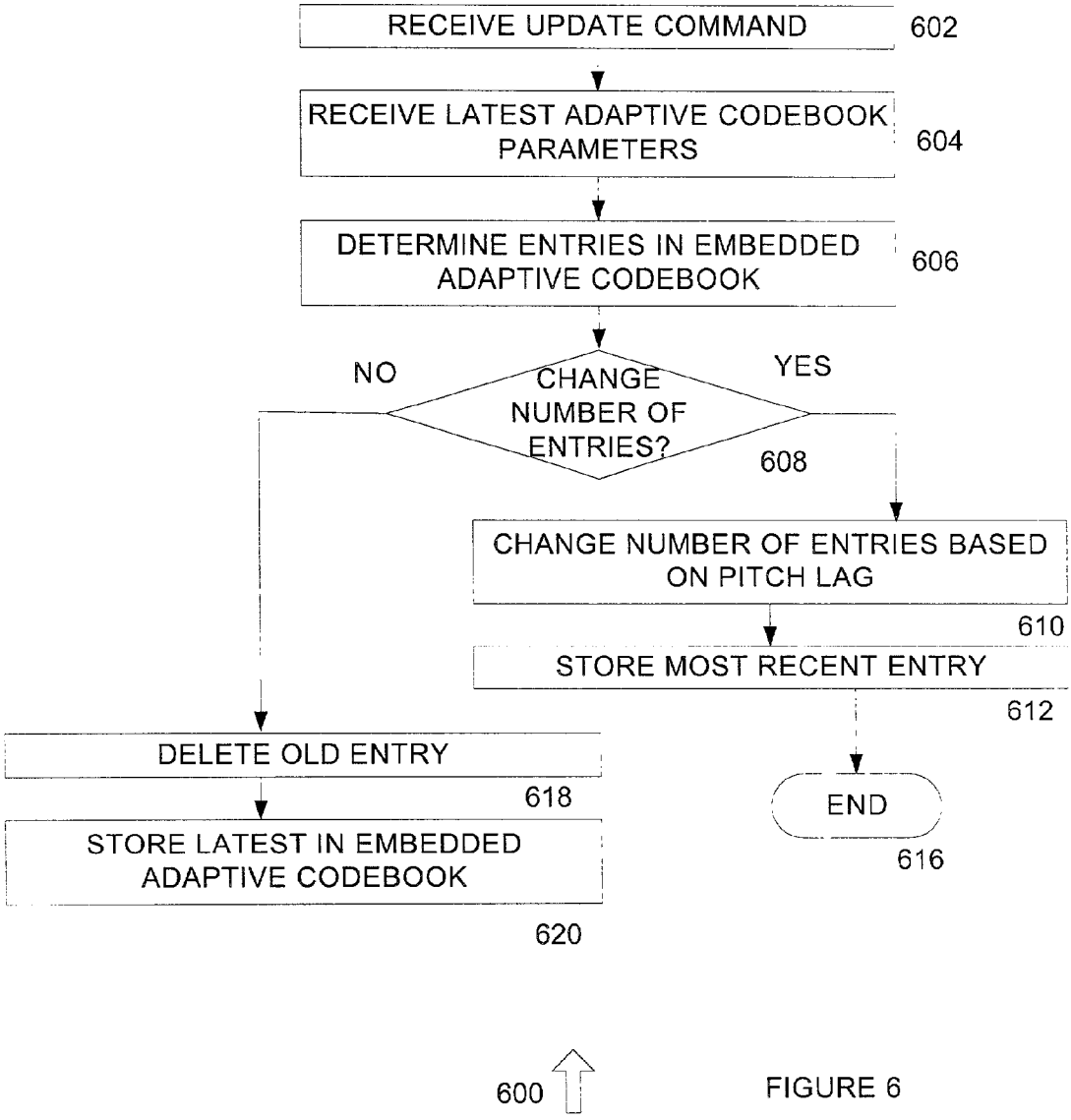
FIG. 6 is a flowchart of a method for updating a fixed code book with embedded adaptive code book in accordance with an exemplary embodiment of the present invention.

FIG. 6 is a flowchart of a method 600 for updating a fixed code book with embedded adaptive code book in accordance with an exemplary embodiment of the present invention. Method 600 begins at 602 where an update command is received. In one exemplary embodiment, the update command can be received after the coding of a frame, subframe, at predetermined times, after generation of an adaptive code book code, or in other suitable manners. The method then proceeds to 604.

At 604, the latest adaptive code book excitation vector parameters are received. In one exemplary embodiment, the adaptive code book excitation vector parameters can be extracted from the adaptive code book by a code book update system, the adaptive code book can generate the parameters for transmission, or other suitable processes can be used. The method then proceeds to 606.

At 606, the entries in an embedded adaptive code book are determined. In one exemplary embodiment, the embedded adaptive code book can have a predetermined number of slots for adaptive code book entries, and the best entry can be identified. The method then proceeds to 608.

AT 608, it is determined whether the number of entries in the embedded adaptive code book needs to be changed. If it is determined that the number of entries needs to be changed, the method proceeds to 610 where the number of entries is adjusted based on the pitch lag. The method then proceeds to 612 where the latest entry is stored, such as in a new entry location, by replacing the old entry, or in other suitable manners. The method then proceeds to 616 and terminates.

If it is determined at 608 that the number of entries in the embedded adaptive code book does not need to be changed, the method proceeds to 618 where the old entry is deleted. In one exemplary embodiment, the old entry can be deleted when the new entry is written on it, or can be deleted prior to writing the new entry, or in other suitable manners. The method then proceeds to 620 where the latest entry is stored in the embedded adaptive code book.

In operation, method 600 allows long term processing excitation code vectors to be stored in an embedded code book of a fixed code book so as to prevent long term processing failure if a dramatic change in the spectrum or pitch lag occurs. Method 600 allows the size of the embedded adaptive code book to be adjusted.

While various embodiments of the invention have been described, it will be apparent to those of ordinary skill in the art that many more embodiments and implementations are possible that are within the scope of this invention.

What is claimed is:

1. A system for code excited linear prediction coding of speech signals comprising:

a fixed code book with an embedded adaptive code book that is configurable to select excitation vector parameters, wherein the fixed code book includes both fixed codes and adaptive codes;

an adaptive code book that is configurable to select long term processing excitation vector parameters; and a code book update system that is configurable to update the fixed code book with the embedded adaptive code book based on the long term processing excitation vector parameters;

wherein the system is configurable to determine whether the long term processing excitation vector parameters from the adaptive code book are suitable for coding of the speech signals, and if suitable, the system is configurable to use the long term processing excitation vector parameters from the adaptive code book for coding of the speech signals, and if not suitable, the system is configurable to use long term processing excitation vector parameters from the fixed code book with the embedded adaptive code book for coding of the speech signals;

wherein adaptive codes of the adaptive codebook have a different pitch lag search range than the adaptive codes of the fixed codebook.

2. The system of claim 1 wherein the code book update system further comprises an embedded adaptive code book interface system that is configurable to receive the long term processing excitation vector parameters from the adaptive code book or from past synthesized excitation.

3. The system of claim 1 wherein the code book update system further comprises an adaptive code book entry monitor that is configurable to determine whether the long term processing excitation vector parameters from the adaptive code book are different from the long term processing excitation vector parameters in the fixed code book with the embedded adaptive code book.

4. The system of claim 1 wherein the code book update system further comprises a fixed code book interface system that is configurable to determine best excitation vector parameters in the embedded adaptive code book.

5. The system of claim 1 wherein the code book update system further comprises a fixed code book update system that is configurable to replace old excitation vector parameters with new ones in the embedded adaptive code book.

6. The system of claim 1 wherein the fixed code book with the embedded adaptive code book further comprises a fixed and adaptive code search system that is configurable to locate the excitation vector parameters in the fixed code book and in the embedded adaptive code book.

7. The system of claim 1 wherein a first code book gain is applied to the fixed codebook with the embedded adaptive code book, and wherein a second code book gain is applied to the adaptive code book.

8. The system of claim 1 wherein the system determines that the long term processing excitation vector parameters from the adaptive code book are not suitable for coding of the speech signals due to a substantial change in spectrum of the speech signal.

9. The system of claim 1 wherein the system determines that the long term processing excitation vector parameters from the adaptive code book are not suitable for coding of the speech signals due to a substantial change in pitch lag of the speech signal.

10. The system of claim 1 wherein the adaptive codes of the adaptive codebook have a limited pitch lag search range compared to the adaptive codes of the fixed codebook.

11. A method for code excited linear prediction coding of speech signals comprising:

searching an adaptive code book for long term processing excitation vector parameters;

searching a fixed code book with an embedded adaptive code book for excitation vector parameters, wherein the fixed code book includes both fixed codes and adaptive codes;

determining whether the long term processing excitation vector parameters from the adaptive code book are suitable for coding of the speech signals;

if suitable, selecting the long term processing excitation vector parameters from the adaptive code book for coding of the speech signals if not suitable, selecting long term processing excitation vector parameters from the fixed code book with the embedded adaptive code book for coding of the speech signals; and using the excitation vector parameters and the selected long term processing excitation vector parameters to generate an excitation signal;

wherein adaptive codes of the adaptive codebook have a different pitch tag search range than the adaptive codes of the fixed codebook.

12. The method of claim 11 further comprising updating the fixed code book with the embedded adaptive code book with the long term processing excitation vector parameters from the adaptive code book.

13. The method of claim 11 further comprising:

determining whether an entry in the fixed code book with the embedded adaptive code book is optimal; and updating the fixed code book with the embedded adaptive code book with the long term processing excitation vector parameters from the adaptive code book.

14. The method of claim 11 wherein searching the fixed code book with the embedded adaptive code book for the excitation vector parameters further comprises using a fixed and adaptive code search system.

15. The method of claim 11 wherein searching the fixed code book with the embedded adaptive code book for the excitation vector parameters further comprises:

determining a previous entry type; and searching the fixed code book with the embedded adaptive code book based on the previous entry type.

16. The method of claim 11 wherein searching the fixed code book with the embedded adaptive code book for the excitation vector parameters further comprises using a search algorithm that applies different weightings to fixed code book entries and to embedded adaptive code book entries.

17. The method of claim 11 further comprising adjusting a size of the embedded adaptive code book.

18. The method of claim 11 further comprising:

applying a first code book gain to the fixed codebook with the embedded adaptive code book; and applying a second code book gain to the adaptive code book.

19. The method of claim 11 the determining determines that the long term processing excitation vector parameters from the adaptive code book are not suitable for coding of the speech signals due to a substantial change in spectrum of the speech signal.

20. The method of claim 11 the determining determines that the long term processing excitation vector parameters from the adaptive code book are not suitable for coding of the speech signals due to a substantial change in pitch lag of the speech signal.

21. The method of claim 11 wherein the adaptive codes of the adaptive codebook have a limited pitch lag search range compared to the adaptive codes of the fixed codebook.

* * * * *

UNITED STATES PATENT AND TRADEMARK OFFICE

CERTIFICATE OF CORRECTION

PATENT NO. : 7,103,538 B1
APPLICATION NO. : 10/166315
DATED : September 5, 2006
INVENTOR(S) : Yang Gao It is certified that error appears in the above-identified patent and that said Letters Patent is hereby corrected as shown below:

In the claims, column 10, line 12, “tag” should be changed to --lag--.

Signed and Sealed this

Nineteenth Day of December, 2006

JON W. DUDAS
*Director of the United States Patent and Trademark Office*